US006976507B1

(12) United States Patent
Webb et al.

(10) Patent No.: US 6,976,507 B1
(45) Date of Patent: Dec. 20, 2005

(54) APPARATUS FOR CREATING PULSATING FLUID FLOW

(75) Inventors: Earl D. Webb, Wilson, OK (US); James C. Tucker, Springer, OK (US); Mardy L. Meadows, Duncan, OK (US); Robert L. Pipkin, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 11/053,427

(22) Filed: Feb. 8, 2005

(51) Int. Cl.[7] ..... F15C 1/08

(52) U.S. Cl. ..... 137/826; 137/833; 137/835; 137/839

(58) Field of Search ..... 137/826, 833, 137/835, 839

(56) References Cited

U.S. PATENT DOCUMENTS

| | | | | |
|---|---|---|---|---|
| 3,158,166 A | | 11/1964 | Warren | 137/81.5 |
| 3,181,546 A | | 5/1965 | Boothe | 137/81.5 |
| 3,181,596 A | | 5/1965 | Winnan et al. | 160/206 |
| 3,247,861 A | | 4/1966 | Bauer | 137/81.5 |
| 3,405,770 A | | 10/1968 | Galle et al. | 175/56 |
| 3,423,026 A | | 1/1969 | Carpenter | 238/284 |
| 3,432,102 A | | 3/1969 | Turner et al. | 239/242 |
| 3,563,462 A | | 2/1971 | Bauer | 239/102 |
| 3,741,481 A | | 6/1973 | Bauer | 239/102 |
| 3,902,367 A | * | 9/1975 | Grant et al. | 73/861.19 |
| 3,998,386 A | | 12/1976 | Viets et al. | 239/102 |
| 4,006,755 A | | 2/1977 | Kranz et al. | 137/831 |
| 4,007,625 A | | 2/1977 | Houben et al. | 73/23 |
| 4,052,002 A | | 10/1977 | Stouffer et al. | 239/4 |
| 4,157,161 A | | 6/1979 | Bauer | 239/11 |
| 4,184,636 A | | 1/1980 | Bauer | 239/11 |
| 4,244,230 A | | 1/1981 | Bauer | 73/861.19 |
| 4,463,904 A | * | 8/1984 | Bray, Jr. | 239/589.1 |
| 4,630,689 A | | 12/1986 | Galle et al. | 175/56 |
| 4,775,016 A | | 10/1988 | Barnard | 175/56 |
| 4,976,155 A | * | 12/1990 | Challandes | 73/861.19 |
| 5,135,051 A | | 8/1992 | Facteau et al. | 166/104 |
| 5,165,438 A | | 11/1992 | Facteau et al. | 137/1 |
| 5,228,508 A | | 7/1993 | Facteau et al. | 166/177 |
| 5,396,808 A | | 3/1995 | Huang et al. | 73/861.19 |
| 5,396,809 A | | 3/1995 | Huang | 73/861.19 |
| 5,505,262 A | | 4/1996 | Cobb | 166/312 |

(Continued)

OTHER PUBLICATIONS

Uzol, O., et al, *Experimental and Computational Visualization and Frequency Measurement of the Jet Oscillation Inside a Fluidic Oscillator, PIV'01 Paper 1029*, 2001, 4th International Symposium on Particle Image Velocimetry, Gottingen, Germany, Sep. 17-19 (also 2002, *Journal of Visualization*, vol. 5, No. 3, pp. 263-273).

(Continued)

*Primary Examiner*—A. Michael Chambers
(74) *Attorney, Agent, or Firm*—John W. Wustenberg; Baker Botts LLP

(57) ABSTRACT

A fluidic oscillator is disclosed, wherein the fluidic oscillator includes a fluid source and a housing coupled to the fluid source. At least one recess is formed within the housing. An insert resides within each at least one recess; the insert provides at least one substantially flat surface. A fluid flowpath in the at least one substantially flat surface generates fluid pulses from fluid received from the fluid source.

20 Claims, 6 Drawing Sheets

U.S. PATENT DOCUMENTS

| | | | | |
|---|---|---|---|---|
| 5,749,525 | A * | 5/1998 | Stouffer | 239/284.1 |
| 5,893,383 | A | 4/1999 | Facteau | 137/14 |
| 6,240,945 | B1 * | 6/2001 | Srinath et al. | 137/14 |
| RE38,013 | E | 3/2003 | Stouffer | 239/284.1 |
| 6,572,570 | B1 | 6/2003 | Burns et al. | 601/148 |
| 6,606,915 | B2 | 8/2003 | Vannuffelen | 73/861.22 |

OTHER PUBLICATIONS

Payne, R. A., et al, *Pressure Fluctuating Tool, SPE 13803*, 1985, Society of Petroleum Engineers, pp. 105-110 (presented SPE 1985 Production Operations Symposium, Oklahoma City, OK, Mar. 10-12).

* cited by examiner

FIG. 1
(PRIOR ART)
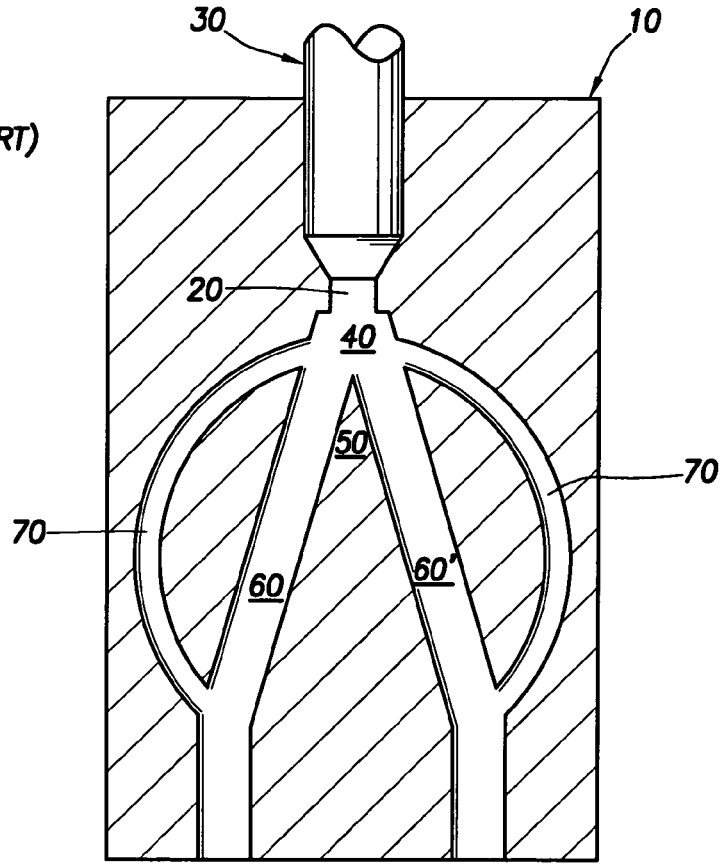
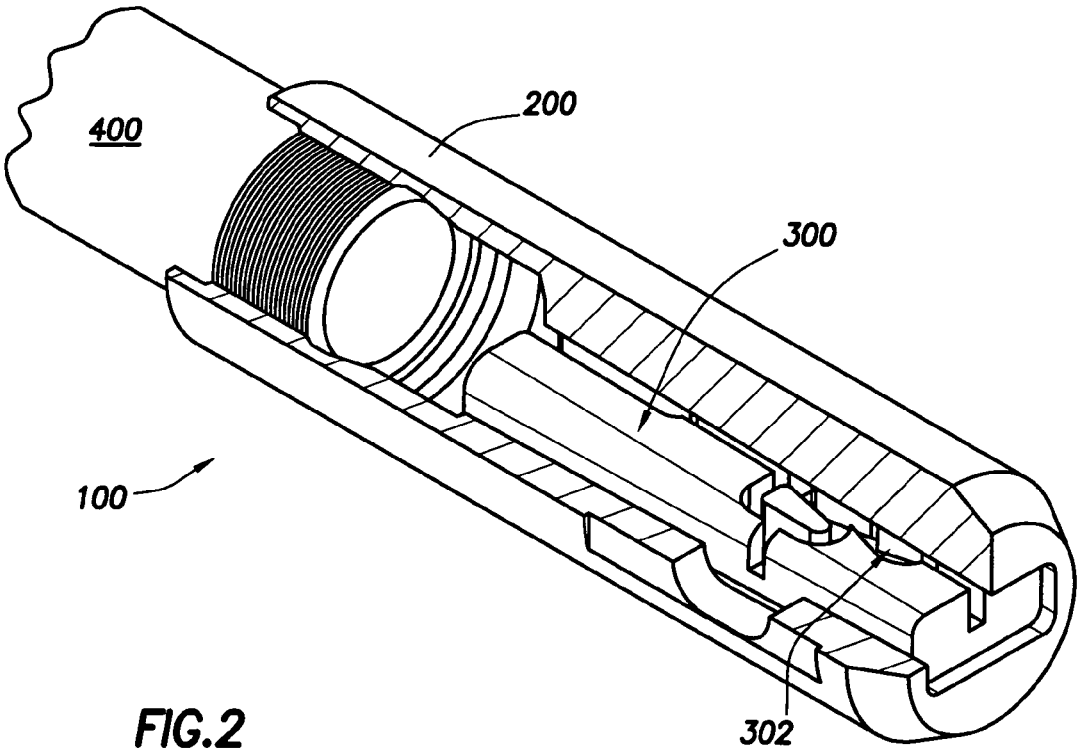
FIG. 2

APPARATUS FOR CREATING PULSATING FLUID FLOW

BACKGROUND

The present invention relates to apparatuses for creating pulsating fluid flow. Known as fluidic oscillators, these devices connect to a source of fluid flow, provide a mechanism for oscillating the fluid flow between two different locations within the device, and emit fluid pulses downstream of the source of fluid flow. Fluidic oscillators require no moving parts to generate the oscillations and have been used in various applications for which pulsating fluid flow is desired, such as massaging showerheads, flowmeters, and windshield-wiper-fluid-supply units.

A fluidic oscillator may include a body 10 with a nozzle 20 that attaches to a fluid source 30, as shown in FIG. 1. The nozzle 20 expels the fluid as a jet into a chamber 40 toward a flow splitter 50. This flow splitter 50 traditionally assumes a triangular or trapezoidal shape, with a narrow leading edge directly in the path of the jet. The sides of flow splitter 50 form the inner walls of two fluid pathways 60 and 60' that diverge and exit the apparatus. The body 10 forms the outer walls of the two fluid pathways 60 and 60', as well as at least two feedback passages 70 and 70' leading from the fluid pathways back into the chamber. Each feedback passage 70 or 70' will be disposed along one of the fluid pathways, 60 or 60', respectively.

The jet will cling to one side of chamber 40 due to a phenomenon called the Coanda effect, explained in more detail later in this disclosure. Thus, the fluid will flow through one of the two fluid pathways 60 or 60' at a time. Flow splitter 50 also helps guide the flow into either fluid pathway 60 or fluid pathway 60'. As the fluid flows through one fluid pathway such as fluid pathway 60, feedback passage 70 will divert a portion of the fluid and return it to chamber 40. The fluid will then disturb the fluid flow along the side of chamber 40 closest to fluid pathway 60. This disturbance will cause the fluid flow to switch to the side of the chamber closest to fluid pathway 60'. Fluid will thus leave from fluid pathway 60', rather than from fluid pathway 60. As a result, the apparatus for creating pulsating fluid flow will emit pulses of fluid in succession from the two fluid pathways 60 and 60', with only one fluid pathway 60 or 60' ejecting fluid at a given time.

Fluidic oscillators may be manufactured from two rectangular blocks of a material suitable for the particular application. For example, if the fluidic oscillator will be used in a well bore, stainless steel blocks may be appropriate. A flowpath may be machined into the largest flat surface of one of the rectangular blocks. The two blocks may be joined together, and the entire apparatus may be lathed into a generally cylindrical form. This design has several flaws: it requires a time-, labor-, and material-intensive method of manufacture and does not permit on-the-fly changes to the flowpath in the field. More importantly, if the fluid-flow path erodes beyond repair, the entire fluidic oscillator must be replaced.

Some applications for fluidic oscillators require sharper fluid pulses than others. For example, fluidic oscillators may be used to clean fluid flowlines or well bores. The fluidic oscillator may be joined to a source of cleaning fluid and then inserted into the flowline or well bore, where the pulses of cleaning fluid can break up any buildup or debris on the inside of the flowline or well bore. Pulsating fluid flow has been found to be superior to steady fluid flow for cleaning surfaces such as the interior of a fluid flowline or well bore.

Moreover, sharp fluid pulses dislodge buildup and debris from these surfaces better than less-defined fluid pulses. Many current fluidic oscillators, however, may not provide the pulse definition cleaning applications require. In addition, current fluidic oscillators often emit fluid parallel to the nozzle and thus may not effectively clean areas located alongside the apparatus. For example, a fluidic oscillator that emits pulses of fluid parallel to the fluid nozzle may not effectively remove matter caked on the well bore because it will eject fluid only down the center of the well bore, not at the sides.

Fluidic oscillators also often rely on atmospheric air entering the fluid pathway to boost the oscillations. As a result, these fluidic oscillators exhibit erratic, weak or even no oscillation when used in submerged environments such as fluid flowlines or well bores. These apparatuses fail to provide reliable, robust fluid pulses in environments where air is unavailable, such as in fluid flowlines or well bores.

SUMMARY

The present invention relates to apparatuses for creating pulsating fluid flow. A fluidic oscillator is disclosed, wherein an example fluidic oscillator includes a fluid source and a housing coupled to the fluid source. At least one recess is formed within the housing. An insert resides within each at least one recess; the insert provides at least one substantially flat surface. A fluid flowpath in the at least one substantially flat surface generates fluid pulses from fluid received from the fluid source. At least one port on the housing allows the fluid pulses to escape from the fluid flowpath to outside the housing.

An alternative example fluidic oscillator is also provided. This example fluidic oscillator includes a fluid source and a housing, wherein the housing is coupled to the fluid source. At least one tapered recess is formed within the housing. A tapered insert resides within each at least one tapered recess. The tapered insert provides at least one substantially flat surface. An inlet into which fluid flows is also provided, wherein the inlet is formed on the at least one substantially flat surface. The fluidic oscillator also includes a chamber having an upstream end and a downstream end, wherein the chamber is formed on the at least one substantially flat surface, wherein the chamber is defined by a pair of outwardly-projecting sidewalls, and wherein the inlet is disposed at the upstream end of the chamber. At least two feedback passages are formed on the at least one substantially flat surface, wherein the at least two feedback passages have opposed entrances at the downstream end of the chamber and opposed exits at the upstream end of the chamber near where the chamber joins the inlet. A feedback cavity is formed on the at least one substantially flat surface, wherein the feedback cavity is disposed at the downstream end of the chamber. At least one exit flowline leaves each of the feedback passages, wherein the at least one exit flowline is formed on the at least one substantially flat surface. At least one port in the housing allows fluid to escape from the at least one exit flowline to outside of the housing.

Another alternative example fluidic oscillator is provided. This example fluidic oscillator includes a fluid source and a housing coupled to the fluid source. Four recesses are formed within the housing; the four recesses are evenly spaced about a central longitudinal axis of the housing. An insert resides within each of the four recesses, wherein the insert provides at least one substantially flat surface. A fluid flowpath is provided on the at least one substantially flat surface, wherein the fluid flowpath generates fluid pulses from fluid received from the fluid source. At least one port on the housing allows the fluid pulses to escape from the fluid flowpath to outside the housing.

The features and advantages of the present invention will be readily apparent to those skilled in the art upon a reading of the detailed description that follows.

BRIEF DESCRIPTION OF THE DRAWINGS

A more complete understanding of the present disclosure and advantages thereof may be acquired by referring to the following description taken in conjunction with the accompanying drawings, wherein:

FIG. 1 illustrates a prior art fluidic oscillator;

FIG. 2 illustrates an example fluidic oscillator with a portion of its housing removed to expose an insert.

Figure 3:
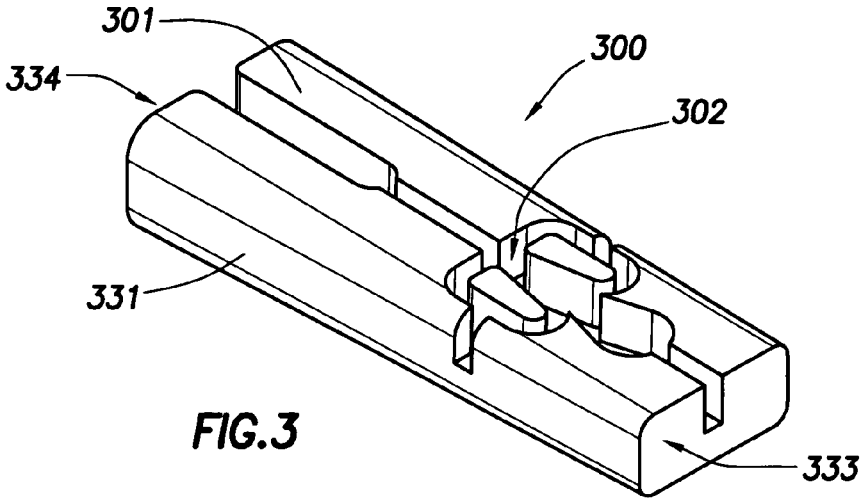
FIG. 3 illustrates an insert for an example fluidic oscillator.

While the present invention is susceptible to various modifications and alternative forms, specific exemplary embodiments thereof have been shown by way of example in the drawings and are herein described in detail. The description herein of specific embodiments is not intended to limit the invention to the particular forms disclosed. On the contrary, the intention is to cover all modifications, equivalents, and alternatives falling within the spirit and scope of the invention as described by the appended claims.

DETAILED DESCRIPTION

FIG. 2 illustrates an example fluidic oscillator 100. Example fluidic oscillator 100 comprises a housing 200 that encloses at least one insert 300. Insert 300 contains flowpath 302, which generates the oscillation effect that drives the fluid pulses. FIG. 2 displays a partially cutaway view of housing 200 to better display insert 300 and flowpath 302. The example housing shown in FIG. 2 is cylindrical, with a circular cross-section; housing 200 may alternatively take other forms, including, but not limited to, a bar-shaped form with a rectangular cross-section. Alternatively, housing 200 may include multiple inserts, as discussed in more detail later in this disclosure. A fluid flowline 400 supplies fluid to fluidic oscillator 100. Fluid flowline 400 may fit inside housing 100 or alternatively connect to fluidic oscillator 100 via a transitional piece (not shown in FIG. 2).

Housing 200 and insert 300 may be formed of any material capable of withstanding the environment in which fluidic oscillator 100 will be used. If, for example, fluidic oscillator 100 will be used to clean a flowline or well bore containing formation fluids, housing 200 and insert 300 may be formed of metal. Alternatively, housing 200 and insert 300 may be formed of a phenolic plastic capable of withstanding a downhole environment. Fluidic oscillator 100's design allows the user to replace insert 300 without replacing fluidic oscillator 100 entirely. That is, if flowpath 302 erodes after heavy use, insert 300 may be replaced and housing 200 may be reused. The use of an insert 300 also permits customization of the flowpath in the field.

Figure 4:
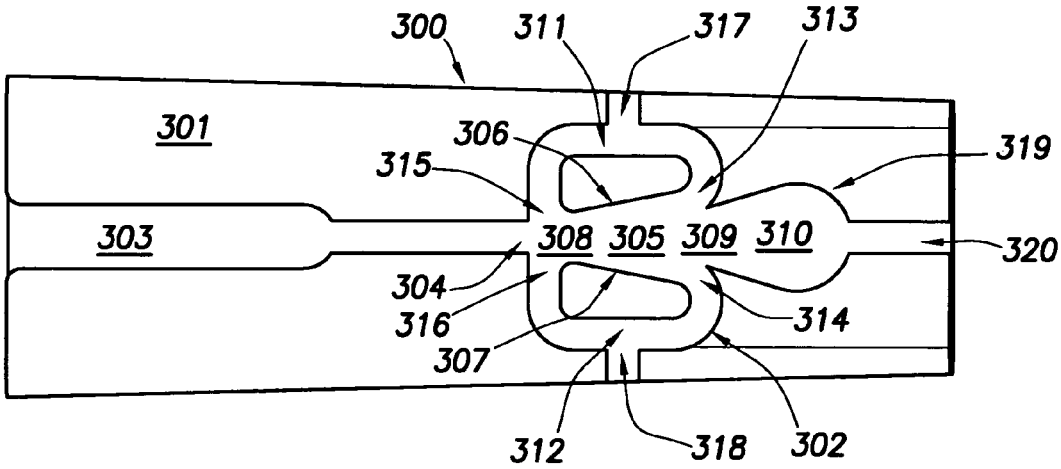
FIG. 4 illustrates a pattern view of an insert for an example fluidic oscillator.

FIGS. 3 and 4 illustrate an example insert 300. As shown in FIG. 3, insert 300 has flowpath 302 cut into its upper surface 301; flowpath 302 may be created through traditional machining processes, such as milling, casting, or molding or may be generated through an Electrical Discharge Machining (EDM) process. For ease of illustration, FIG. 4 illustrates a plan view of flowpath 302 in upper surface 301. Fluid supplied by fluid flowline 400 enters into flowpath 302 via interior flowline 303 and passes through inlet 304. Interior flowline 303 may decrease in width as it approaches inlet 304 to form a focused jet as it enters inlet 304. The fluid passes through inlet 304 into chamber 305. Chamber 305 is defined by two outwardly projecting sidewalls 306 and 307 and has an upstream end 308 and a downstream end 309. A feedback cavity 310 is disposed at downstream end 309.

Flowpath 302 may have the configuration of the flowpath described and depicted in the application for United States Patent entitled "Apparatus and Method for Creating Pulsating Fluid Flow, and Method of Manufacture for the Apparatus," Ser. No. 10/808,986 filed on Mar. 25, 2004, assigned to the assignee of this disclosure. The fluid forms a jet as it streams from inlet 304 into chamber 305 in example insert 300. As the jet leaves inlet 304, the fluid tends to cling to one of the two outwardly projecting sidewalls 306 or 307. This tendency is a result of the well-documented phenomenon known as the "Coanda effect." When the fluid exits inlet 304 as a jet into chamber 305, it draws any fluid between the jet and one of the two outwardly projecting sidewalls 306 or 307 into the jet. For example, the jet may first draw fluid between the jet and outwardly projecting sidewall 306 into the jet. The temporary absence of fluid between the jet and outwardly projecting sidewall 306 creates a low-pressure region. Before the ambient pressure in chamber 305 can restore pressure to this region, the jet is drawn to outwardly projecting sidewall 306 and clings to its surface. The result of this Coanda effect is that the fluid enters chamber 305 along one of the outwardly projecting sidewalls 306 or 307, rather than through the center of chamber 305.

The pulsating action of the fluid flow generated by exemplary fluidic oscillator 100 arises from switches in the fluid flow from along outwardly projecting sidewall 306 to along outwardly projecting sidewall 307, and vice versa. At least two feedback passages 311 and 312 are disposed on opposite sides of chamber 305 to help achieve these switches. Two opposed entrances 313 and 314 leave from downstream end 309 of chamber 305. Two opposed exits 315 and 316 to feedback passages 311 and 312 join upstream end 308 of chamber 305. To continue with the example of the previous paragraph, a portion of the fluid traveling alongside outwardly projecting sidewall 306 will reach opposed entrance 313 and be diverted into feedback passage 311. Most of the fluid that enters feedback passage 311 will exit insert 300 through exit flowline 317, as discussed later in this disclosure in more detail. The remaining fluid that enters feedback passage 311, however, will return to chamber 305 through opposed exit 315. The entry of this fluid into chamber 305 disturbs the path of the jet of fluid issuing from inlet 304 such that the jet no longer adheres to outwardly projecting sidewall 306. The jet of fluid instead will adhere to outwardly projecting sidewall 307 in the same manner as it adhered to outwardly projecting sidewall 306.

The jet of fluid will then travel along outwardly projecting sidewall 307, and a portion of the fluid will enter feedback passage 312 through opposed entrance 314. Most of the fluid will exit insert 300 through exit flowline 318, as discussed in detail later in this disclosure. The remaining fluid in feedback passage 312 will continue to opposed exit 316 and return to chamber 305. As with the fluid entering chamber 305 from opposed exit 315, the fluid passing through opposed exit 316 will disturb the flow of fluid along the surface of outwardly projecting sidewall 307. The fluid will then switch from traveling alongside outwardly projecting sidewall 307 to traveling alongside outwardly projecting sidewall 306, and the cycle will repeat.

At any time when fluid flows along outwardly projecting sidewall 306 and through feedback passage 311, no fluid flows along outwardly projecting sidewall 307 or through feedback passage 312. The converse is also true: no fluid flows along outwardly projecting sidewall 306 or through feedback passage 311 while fluid flows along outwardly projecting sidewall 307 and through feedback passage 312. This oscillation of fluid from one half of insert 300 to the other helps create the desired pulsating fluid flow. In particular, as fluid travels through either feedback passage 311 or 312, exit flowline 317 or 318, respectively, will draw off a portion of the passing fluid. Fluid entering exit flowline 317 or 318 will exit insert 300. The effect of the oscillation of the fluid between outwardly projecting sidewall 306 and outwardly projecting sidewall 307 is that fluid will exit through only one exit flowline 317 or 318 at a time. Thus insert 300 will emit pulses of fluid from one side to the other, in succession.

Exit flowlines 317 and 318 in this example insert 300 are perpendicular to feedback passages 311 and 312, respectively. Exit flowlines 317 and 318 may, however, take any number of different paths, as described in the application for United States Patent entitled "Apparatus and Method for Creating Pulsating Fluid Flow, and Method of Manufacture for the Apparatus," Ser. No. 10/808,986 filed on Mar. 25, 2004, assigned to the assignee of this disclosure. For example, fluidic oscillator 100 might be used to clean the interior walls of a fluid flowline or a well bore. If exit flowlines 317 and 318 are perpendicular to feedback passages 311 and 312, the pulses of fluid emitted from insert 300 could jet from the sides of fluidic oscillator 100 (as discussed below) onto the interior walls of the well bore, cleaning their surfaces of collected debris and scale. The best path for the exit flowlines will depend upon how the apparatus will be used, as will be readily apparent to a person of ordinary skill in the art having the benefit of this disclosure.

Feedback cavity 310, disposed at downstream end 309 of chamber 305, further promotes the oscillation of fluid flow in insert 300. While a portion of the fluid traveling along outwardly projecting sidewalls 306 and 307 is directed into opposed entrances 313 and 314, the remainder of the fluid exits chamber 305 into feedback cavity 310. If the fluid enters feedback cavity 310 after traveling along outwardly projecting sidewall 306, the fluid will follow a clockwise path around feedback cavity sidewall 319 and return to chamber 305 near outwardly projecting sidewall 307. This fluid flow will destabilize the fluid flow near outwardly projecting sidewall 307. The added instability amplifies the oscillation effect produced by feedback passage 311 by drawing fluid to outwardly projecting sidewall 307 from outwardly projecting sidewall 306. The cycle then reverses, with fluid entering from outwardly projecting sidewall 307 and following a counterclockwise path in feedback cavity 310 to near outwardly projecting sidewall 306. Example feedback cavity 310 has a rounded shape. Any volume that extends beyond opposed entrances 313 and 314 may serve as a feedback cavity 310, regardless of the shape the volume assumes. At least one forward jet 320 may be present at feedback cavity sidewall 319. Forward jet 320 may be useful for the well bore and fluid flowline cleaning applications discussed previously in this disclosure. For example, if fluidic oscillator 100 travels within a fluid flowline with forward jet 320 at the leading edge, forward jet 320 will jet fluid ahead of fluidic oscillator 100 and could thus clear debris from the path of fluidic oscillator 100. Forward jet 320 should have a smaller cross-section than feedback passages 311 and 312, to prevent disturbances to the pulsating action.

Figure 5:
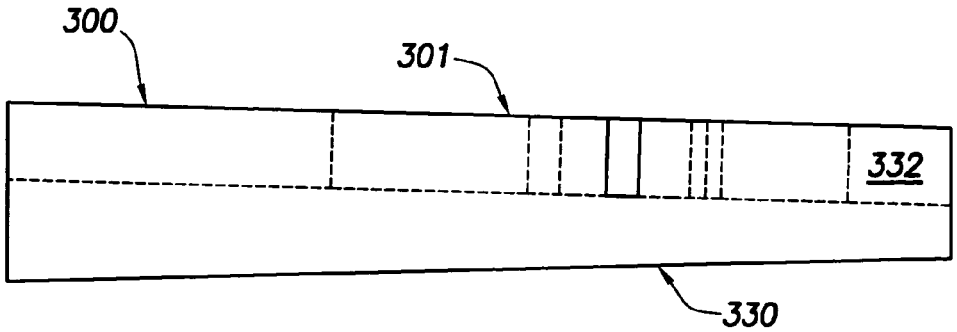
FIG. 5 illustrates a side view of an insert for an example fluidic oscillator.

Insert 300 is wedge-shaped, as illustrated in FIG. 3. Upper surface 301, a corresponding lower surface 330 (not shown in FIG. 3), and two side surfaces 331 and 332 (not shown). Each side slopes such that insert 300 is narrower at its downstream end 333 than at its upstream end 334. The angle of the slope may vary between approximately 0 degrees to approximately 15 degrees. For certain flowline cleaning jobs, a 1.5 degree downward slope from upstream end 334 to downstream end 333 may be desirable. The slope of upper surface 301 and lower surface 330 is made obvious in FIG. 5, which illustrates a side view of insert 300. The tapered wedge shape of insert 300 has the benefit of allowing flowpath 302 to maintain a substantially constant depth inside insert 300 with only a gradual slope downstream in the height of the walls that form flowpath 302. The walls maintain a substantially constant height across the width of the insert at any one location along the fluid flowpath. Rather, the height of the walls will only gradually decrease toward the downstream end of the insert. In contrast, if insert 300 assumed a cylindrical form, the height of the walls that form flowpath 302 would be much shorter near feedback outlets 317 and 318 than near chamber 305. Moreover, the wedge shape for the insert provides a substantially flat surface for flowpath 302. This configuration enhances the performance of fluidic oscillator 100, as compared to, for example, a cylindrical insert which would have a curved surface for the flowpath.

The wedge shape is also more conducive to precision EDM processes and field customization than a cylindrical form would be. Inserts may be customized for particular jobs; a given fluidic oscillator may include multiple inserts that may be switched before use, even on site, depending on the job. The wedge shape of insert 300 also permits a tight, fluid-impermeable fit directly between housing 200 and insert 300. That is, insert 300 may be designed to fit inside housing 200 such that all the outside surfaces of insert 300 directly contact the interior of housing 200 and create a fluid-tight seal that prevents any fluid from escaping from flowpath 302. The direct housing-to-insert seal eliminates the need for any additional sealing structure and thus eliminates a manufacturing and operational variable.

Figure 6:
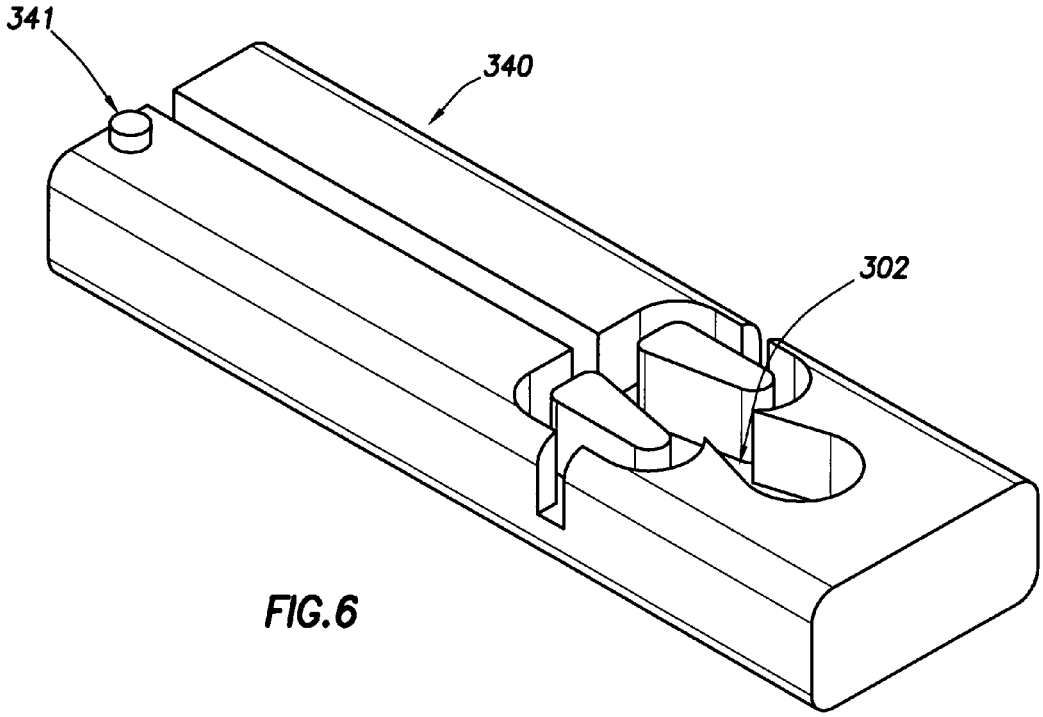
FIG. 6 illustrates an insert for an example fluidic oscillator.

The insert may also assume alternate forms. For example, the insert may be a rectangular block, rather than a wedge. FIG. 6 illustrates a top view of a rectangular insert 340. A tab 341 may be provided to lock insert 340 into housing 200, which is discussed in greater detail later in this disclosure.

Figure 7:
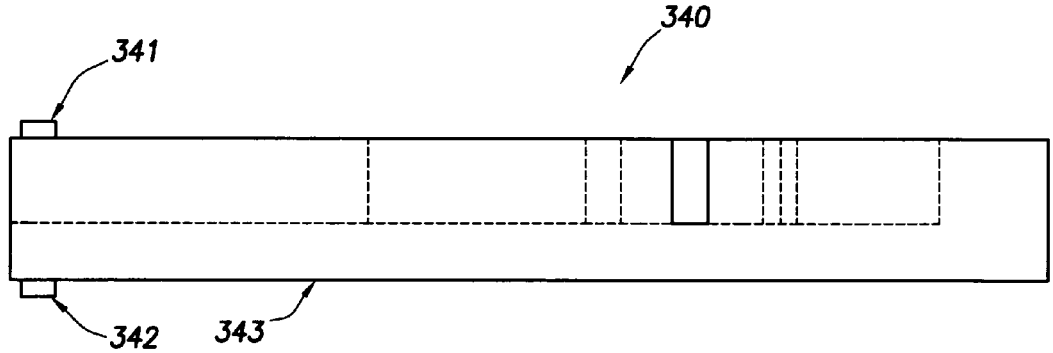
FIG. 7 illustrates a side view of an insert for an example fluidic oscillator.
Figure 8:
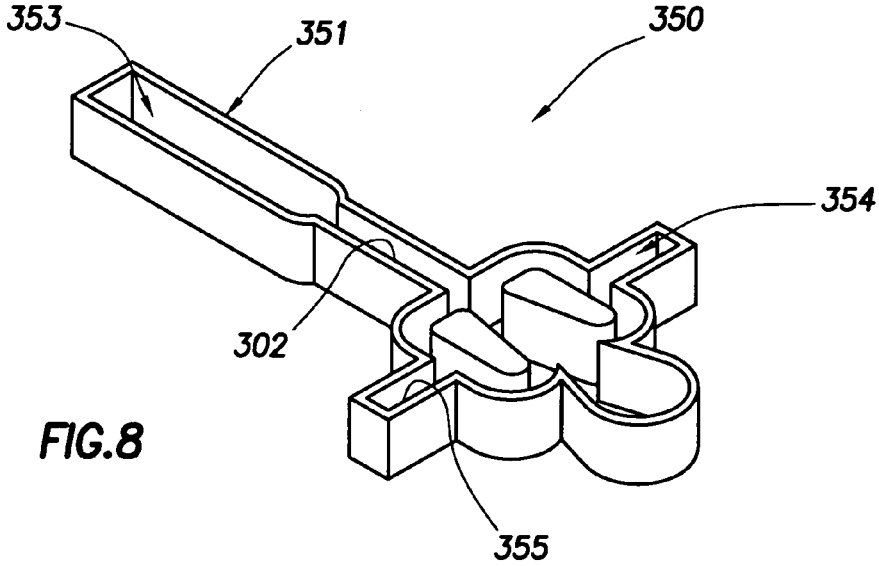
FIG. 8 illustrates an insert for an example fluidic oscillator.

The rectangular profile of insert 340 is evident in FIG. 7, which illustrates a side view of insert 340. A second tab 342 may also be provided on lower surface 343 of insert 340. FIG. 8 displays another sample insert 350. Insert 350 provides enough material to support walls 351 to surround flowpath 302, but not very much more. Thus, rather than assuming a wedge or rectangular shape, the insert assumes a shape that models flowpath 302. Interior flowline 353 and two exit flowlines 354 and 355 may attach to specially-adapted notches in housing 200, which is discussed in greater detail later in this disclosure.

Figure 9:
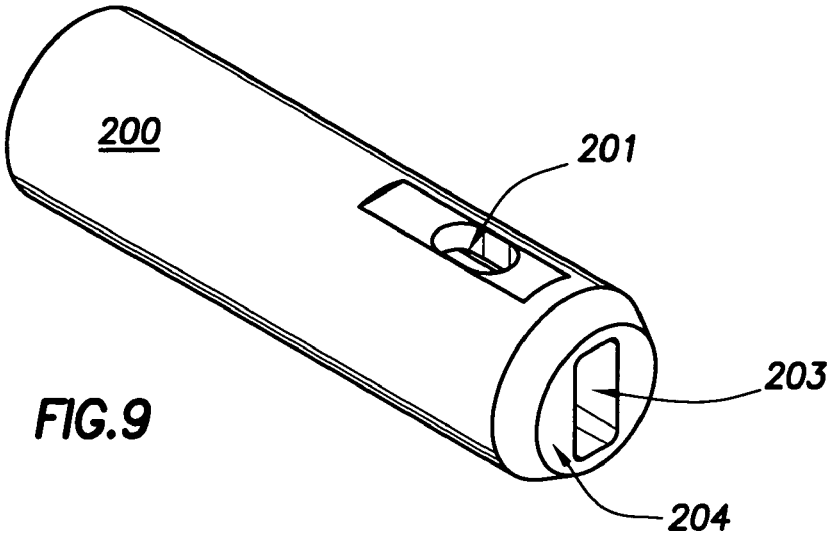
FIG. 9 illustrates a housing for an example fluidic oscillator.

Fluidic oscillator 100 also comprises a housing 200. Examples of housing 200 are illustrated in FIGS. 9, 10, 11 and 12. FIG. 9 illustrates an outside view of a housing 200. Port 201 is positioned to allow fluid exiting from exit flowline 317 in insert 300 to escape housing 200. Although not visible in FIG. 9, a corresponding port 202 is located on the opposite side of housing 200 (180 degrees from port 201). Port 202 allows fluid exiting from exit flowline 318 in insert 300 to escape housing 200. Slot 203 in end 204 of housing 200, fits directly around downstream end 333 of insert 300.

Figure 11:
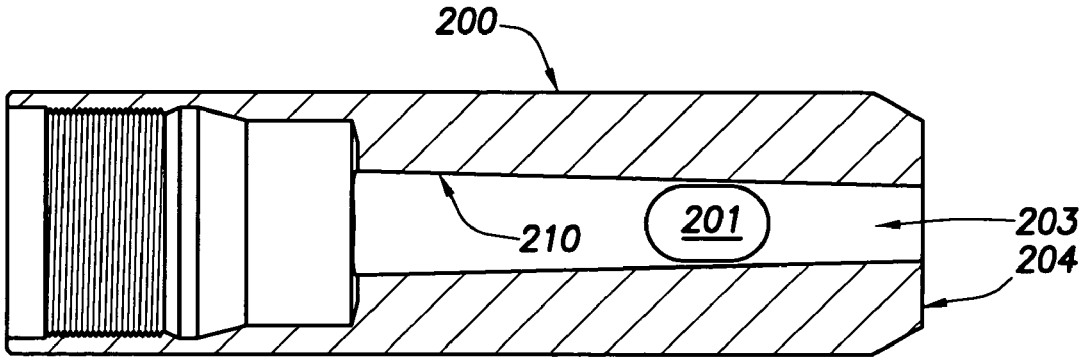
FIG. 11 illustrates a housing for an example fluidic oscillator.
Figure 10:
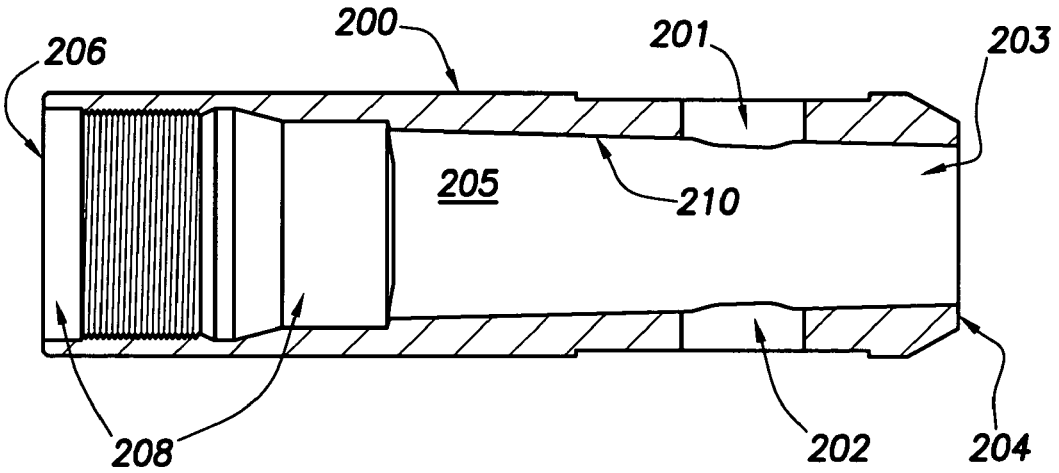
FIG. 10 illustrates a longitudinal cross-section of a housing for an example fluidic oscillator.

FIG. 10 illustrates longitudinal cross-sectional views of housing 200, with ports 201 and 202 at the top and bottom, respectively. To achieve the fluid-tight seal, housing 200 may include a recess 205 that is shaped to receive and directly engage the insert. The insert fits inside recess 205, sliding in through entrance 206 and slot 203 until the insert mates with the housing. If the insert is tapered, like insert 300, recess 205 must be tapered to fit closely over the insert. Surfaces 301, 330, 331 and 332 of insert 300, shown in FIGS. 3, 4, and 5, for example, may create a fluid-tight seal with an inside surface 210 of housing 200. This fluid-tight seal eliminates the need for any intervening sealing mechanism. Just inside entrance 206, a series of threads 208 is provided to engage a fluid flowline 400; the threads may be either male or female or otherwise customized to accommodate a specific fluid flowline 400. FIG. 11 illustrates an additional cross-sectional view of housing 200 in which housing 200 has been rotated about a central longitudinal axis from the view in FIG. 10.

Figure 12:
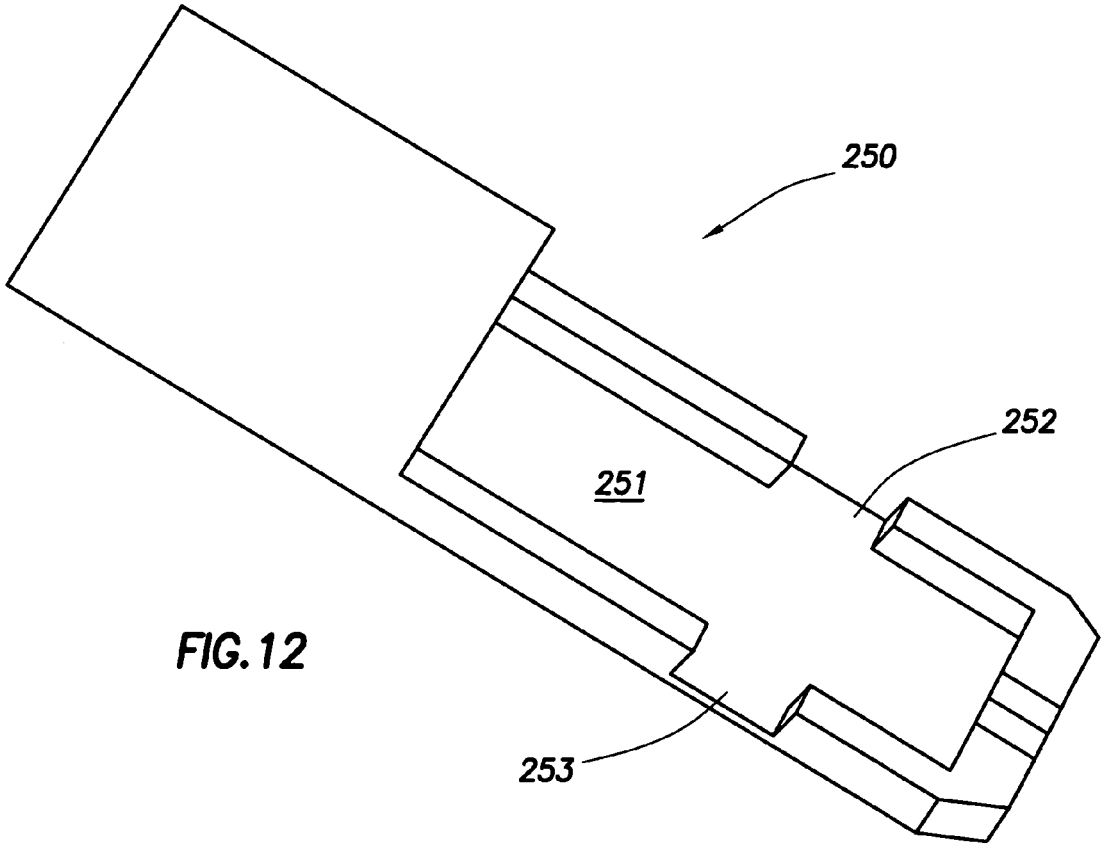
FIG. 12 illustrates a longitudinal cross-section of a housing for an example fluidic oscillator.

If the insert is not tapered, but instead is rectangular, the recess may also be rectangular. The recess may also be rectangular, or otherwise shaped, to accept an insert that is formed only of the walls of the flowpath, such as insert 350. Another example housing 250 for insert 350 is shown in FIG. 12; recess 251 is rectangular. Housing 200 may then have slots 252 and 253 that are specially adapted to accommodate and retain exit flowlines 354 and 355.

Figure 13:
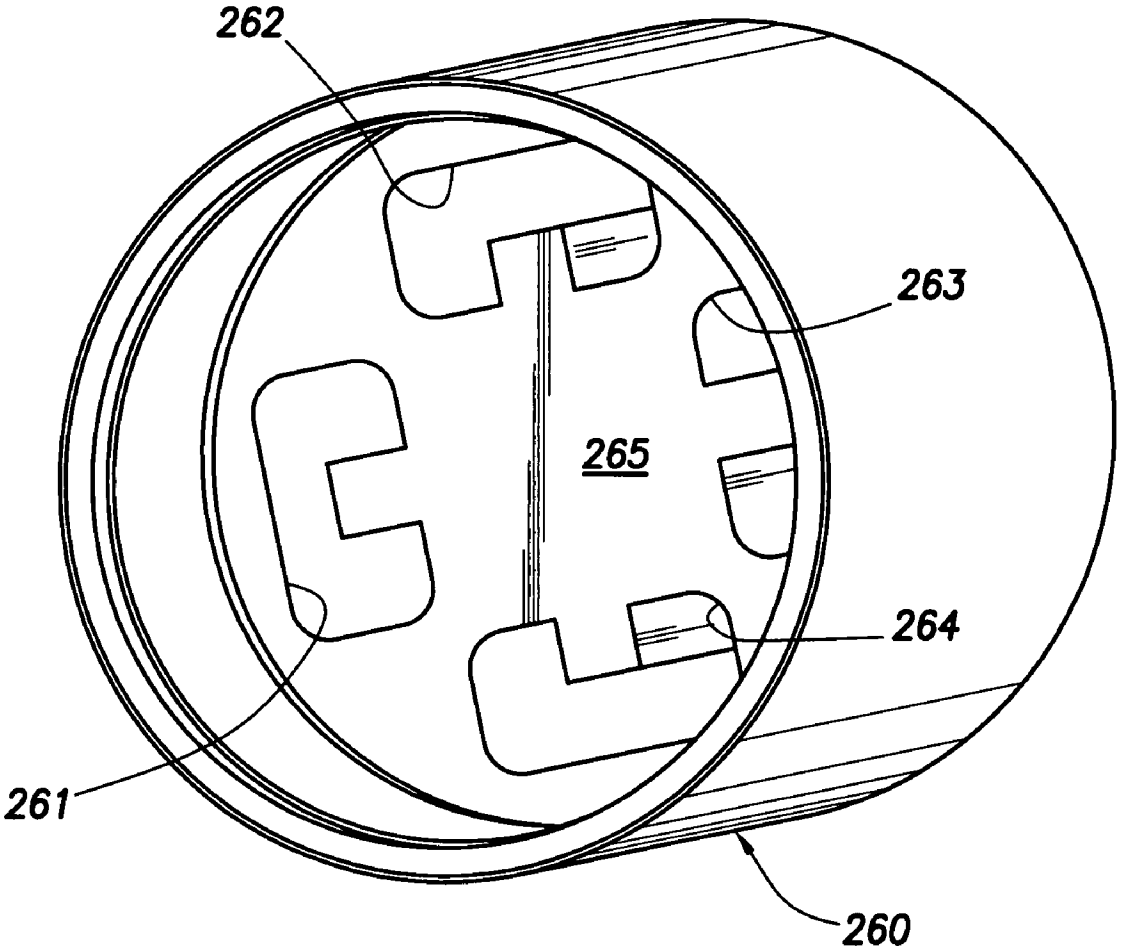
FIG. 13 illustrates a housing for an example fluidic oscillator.

Alternatively, a fluidic oscillator may include a housing designed to accommodate multiple inserts. Such a fluidic oscillator may allow for a higher volume of fluid to pass through this example fluidic oscillator than fluidic oscillators including only one insert, thereby increasing, for example, the potential cleaning performance of the fluidic oscillator. FIG. 13 illustrates an example housing 260 with four recesses 261, 262, 263, and 264 spaced substantially evenly about a central longitudinal axis of housing 260, or approximately 60 degrees apart. Support 265 of housing 260 maintains the spacing between each insert and provides the structure for recesses 261, 262, 263, and 264. Each recess 261, 262, 263, or 264 may enclose one insert, similar to the recesses described previously in this disclosure. Alternatively, housing 260 may include recesses large enough to accommodate more than one insert. As one of ordinary skill in the art having the benefit of this disclosure will realize, housing 260 may enclose any number of inserts spaced at any interval; the housing 260 shown in FIG. 13 is merely an example. The inserts will contain flowpaths that generate fluid pulses in the manner described earlier in this disclosure.

Housing 260 also provides at least one port, not shown in FIG. 13, to allow fluid to escape from each insert, similar to ports 201 and 202. A single high-volume port may be provided. However, multiple ports for the example fluidic oscillator may be aligned such that fluid jets from housing 260 in multiple directions at the same time. For instance, housing 260 may have multiple ports for each insert, allowing the fluidic oscillator to jet fluid in substantially 360 degrees. Such a configuration would allow, for example, the fluidic oscillator to clear debris from nearly the entire inner circumferences of a flowline and potentially reduce the need for multiple cleaning passes by the fluidic oscillator through the flowline.

The present invention is well-adapted to carry out the objects and attain the ends and advantages mentioned, as well as those that are inherent therein. While the invention has been depicted, described, and is defined by reference to the exemplary embodiments of the invention, such a reference does not imply a limitation on the invention, and no such limitation is to be inferred. The invention is capable of considerable modification, alteration, and equivalents in form and function, as will occur to those ordinarily skilled in the pertinent arts and having the benefit of this disclosure. The depicted and described embodiments of the invention are exemplary only and are not exhaustive of the invention. Consequently, the invention is intended to be limited only by the spirit and scope of the appended claims, giving full cognizance to equivalents in all respects.

What is claimed is:

1. A fluidic oscillator, comprising:

a fluid source, a housing, wherein the housing couples to the fluid source, at least one recess formed within the housing, at least one insert residing within each at least one recess, wherein the at least one insert provides at least one substantially flat surface, a fluid flowpath on the at least one substantially flat surface, wherein the fluid flowpath generates fluid pulses from fluid received from the fluid source, at least one feedback passage in the fluid flowpath, at least one exit flowline that forms a fluid connection between the at least one feedback passage in the fluid flowpath and the housing, and at least one port on the housing that allows the fluid pulses to escape from the at least one exit flowline in the fluid flowpath to outside the housing.

2. The fluidic oscillator of claim 1, wherein the at least one insert creates a fluid-tight seal with the recess.

3. The fluidic oscillator of claim 1, wherein the at least one insert and the at least one recess are tapered.

4. The fluidic oscillator of claim 1, wherein the at least one insert and the at least one recess are rectangular.

5. The fluidic oscillator of claim 4, wherein the at least one insert further comprises a tab to lock the insert into the housing.

6. The fluidic oscillator of claim 1, wherein the at least one insert comprises walls surrounding the fluid flowpath.

7. The fluidic oscillator of claim 1, wherein the fluid flowpath comprises:

an inlet into which fluid flows, a chamber having an upstream end and a downstream end, wherein the chamber is defined by a pair of outwardly-projecting sidewalls and wherein the inlet is disposed at the upstream end of the chamber, at least two feedback passages having opposed entrances at the downstream end of the chamber and opposed exits at the upstream end of the chamber near where the chamber joins the inlet, at least one exit flowline leaving each of the feedback passages, and a feedback cavity disposed at the downstream end of the chamber.

8. The fluidic oscillator of claim 7, wherein the flowpath further comprises at least one forward jet exiting the feedback cavity.

9. The fluidic oscillator of claim 8, wherein the at least one exit flowline has a cross-section, and wherein the at least one forward jet has a cross-section that is smaller than the cross-section of the at least one exit flowline.

10. The fluidic oscillator of claim 1, wherein the at least one port is aligned with an exit flowline of the fluid flowpath when the at least one insert resides within the at least one recess.

11. The fluidic oscillator of claim 1, wherein the housing is adapted to couple to a fluid flowline.

12. The fluidic oscillator of claim 11, wherein the housing comprises at least one thread that is adapted to couple to a fluid flowline.

13. The fluidic oscillator of claim 1, wherein the housing comprises a slot that creates a fluid-tight seal with a downstream end of the insert.

14. A fluidic oscillator, comprising:

a fluid source, a housing, wherein the housing is coupled to the fluid source, at least one tapered recess formed within the housing, at least one tapered insert residing within each at least one tapered recess, wherein the at least one tapered insert provides at least one substantially flat surface, an inlet into which fluid flows, wherein the inlet is formed on the at least one substantially flat surface, a chamber having an upstream end and a downstream end, wherein the chamber is formed on the at least one substantially flat surface, wherein the chamber is defined by a pair of outwardly-projecting sidewalls, and wherein the inlet is disposed at the upstream end of the chamber, at least two feedback passages formed on the at least one substantially flat surface, wherein the at least two feedback passages have opposed entrances at the downstream end of the chamber and opposed exits at the upstream end of the chamber near where the chamber joins the inlet, a feedback cavity formed on the at least one substantially flat surface, wherein the feedback cavity is disposed at the downstream end of the chamber, at least one exit flowline leaving each of the feedback passages, wherein the at least one exit flowline is formed on the at least one substantially flat surface, and at least one port in the housing that allows fluid to escape from the at least one exit flowline to outside of the housing.

15. The fluidic oscillator of claim 14, wherein the at least one tapered insert creates a fluid-tight seal with the at least one tapered recess.

16. The fluidic oscillator of claim 14, further comprising at least one forward jet formed within the at least one tapered insert, wherein the at least one forward jet exits the feedback cavity.

17. The fluidic oscillator of claim 16, wherein the at least one exit flowline has a cross-section, and wherein the at least one forward jet has a cross-section that is smaller than the cross-section of the at least one exit flowline.

18. The fluidic oscillator of claim 14, wherein the housing is adapted to couple to a fluid flowline.

19. The fluidic oscillator of claim 14, wherein the housing further comprises a slot that creates a fluid-tight seal with a downstream end of the at least one tapered insert.

20. A fluidic oscillator, comprising:

a fluid source, a housing, wherein the housing couples to the fluid source, at least two recesses formed within the housing, wherein the at least two recesses are substantially evenly spaced about a central longitudinal axis of the housing, at least one insert residing within each of the at least two recesses, wherein the at least one insert provides at least one substantially flat surface, a fluid flowpath on the at least one substantially flat surface, wherein the fluid flowpath generates fluid pulses from fluid received from the fluid source, and at least one port on the housing that allows the fluid pulses to escape from the fluid flowpath to outside the housing.

* * * * *